US006164352A

United States Patent [19]

Simonsen

[11] Patent Number: 6,164,352

[45] Date of Patent: Dec. 26, 2000

[54] WOOD SURFACING HEAD AND METHOD

[75] Inventor: Tobias L. Simonsen, Vancouver, Wash.

[73] Assignee: Key Knife, Tualatin, Oreg.

[21] Appl. No.: 09/405,437

[22] Filed: Sep. 23, 1999

[51] Int. Cl.[7] ..... B27L 11/00; B27C 5/00

[52] U.S. Cl. ..... 144/373; 144/218; 144/117.1; 144/230; 407/49

[58] Field of Search ..... 144/114.1, 117.1, 144/218, 222, 223, 230, 231, 235, 236; 241/292.1, 294; 407/41, 42, 48, 49, 50

[56] References Cited

U.S. PATENT DOCUMENTS

| | | | |
|---|---|---|---|
| 593,500 | 11/1897 | Tillison . | |
| 632,618 | 9/1899 | Anderson . | |
| 920,549 | 5/1909 | Dette . | |
| 1,032,636 | 7/1912 | Watkins . | |
| 2,702,059 | 2/1955 | Ballantine . | |
| 2,792,036 | 5/1957 | Buttke . | |
| 4,485,858 | 12/1984 | Cecchi . | |
| 4,538,655 | 9/1985 | Berkeley | 144/230 |
| 4,658,875 | 4/1987 | Grabovac | 144/230 |
| 4,819,703 | 4/1989 | Rice et al. | 144/230 |
| 4,830,073 | 5/1989 | De Abreu | 144/230 |
| 5,112,162 | 5/1992 | Hartford et al. | 407/49 |
| 5,240,192 | 8/1993 | Tilby et al. | 241/292.1 |

*Primary Examiner*—W. Donald Bray

[57] ABSTRACT

A wood surfacing method and apparatus. A projecting surface projects from a cutting head adapted for rotating a knife about an axis. An article of wood is fed toward the cutting head. The projection projects from the cutting head, behind the knife with respect to the direction of rotation of the cutting head. The projection is adapted to make contact with the wood with a force that is substantially constant as the wood is fed.

9 Claims, 2 Drawing Sheets

WOOD SURFACING HEAD AND METHOD

BACKGROUND OF THE INVENTION

The present invention relates to a cutting head and method for cutting wood chips, particularly for cutting and finishing the surface of the wood in one operation.

Wood that is first obtained in the form of logs generally must be processed to provide finished lumber for use in construction. Often in this processing, a log is cut first to desired dimensions and cut again for surface finishing. Lumber having a higher finish requirement is referred to as being of a higher "grade."

Cutting apparatus typically employ drum-style surfacing "heads," which include a rotating cylinder on which is mounted a plurality of knives for cutting the surface of the wood, which may be lumber or logs. The wood is fed while supported on a horizontal support surface along a generally horizontal path that results in the grazing of the surface of the wood by the knives. Wood chips are thereby removed from the surface of the wood to a predetermined depth. For higher grade lumber, it is typical that such apparatus is not able to provide a satisfactory surface finish. One problem is that the knives cutting the wood cause the wood to vibrate and bounce, thereby deflecting it episodically in a direction perpendicular to the axis of rotation of the head. This results in an uneven or irregular surface which often must be processed further to obtain desired surface planarity, which adds cost and reduces yield.

Accordingly, there is a need for a wood surfacing head and method that provides for cutting the wood while at the same time providing improved finishing of the surface of the wood, thereby providing a lumber grade recovery.

SUMMARY OF THE INVENTION

A wood surfacing head and method according to the present invention solves the aforementioned problem and meets the aforementioned need by providing a projecting surface projecting from a cutting head adapted for rotating a knife about an axis wherein the tip of the knife defines a circle in a plane perpendicular to the axis. An article of wood and the cutting head are translated toward one another along a line that is perpendicular to the axis and that lies in a plane that does not include the axis. The projection projects from the cutting head, behind the knife with respect to the direction of rotation of the cutting head. At least a portion of the outer surface of the projection matches, in the plane of the circle, a curve that falls inwardly away from the circle with distance from the tip of the knife at a rate that corresponds to the speed of the relative translation as related to the angular position of the cutting head.

The projection is adapted to make contact with the wood with a force that is substantially constant.

Therefore, it is a principal object of the present invention to provide a novel and improved wood surfacing head and method.

It is another object of the present invention to provide such a wood surfacing head and method that provides for cutting the wood while at the same time improving the finish of the surface of the wood.

It is still another object of the present invention to provide such a wood surfacing head and method that provides for lumber grade recovery.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

This invention relates to a cutting head and method for cutting wood chips, particularly for finishing the surface of the wood. Commonly, the cutting head is a drum-style surfacing head such as described herein; however, it will be understood that other head configurations may be employed, such as disc shaped cutting heads, without departing from the principles of the invention.

Figure 1:
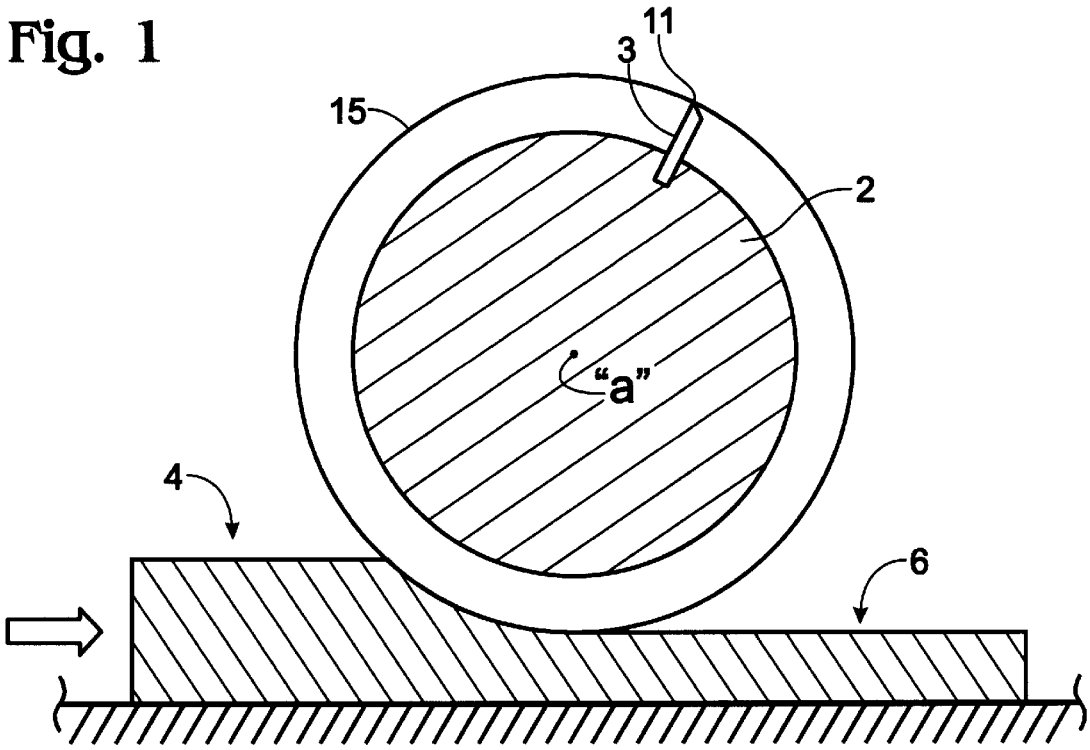
FIG. 1 is a section of a cutting head and an article of wood in a fixed position being cut by the cutting head.

Referring to FIG. 1, a drum-style cutting head 2 includes at least one knife 3. The head is adapted for rotation about a typically fixed axis of rotation "a." An article of wood 4 is placed on a support surface 5 and fed toward the head 2, in the direction of the arrow. As shown, the rotating knife 3 cuts chips from, e.g., the top 4 of the wood, though it is to be understood that the apparatus may be arranged so that chips are cut from the side, bottom or any other portion of the wood as desired. Moreover, the wood may be fixed and the head translated to provide the same result.

As the wood is advanced toward the head, an approximately plane surface 6 is thereby formed; however, it is often the case that the surface 6 is not as plane as desired. One way to make the surface more plane is to use more knives spaced around the outer surface of the head 2. However, as the knives and their mountings occupy space on the head, there is a limit to the number of knives that can be accommodated. Another way to make the surface more plane is to decrease the speed of feeding the wood 4 relative to the speed of rotation of the head, although this has the undesirable effect of decreasing throughput.

It has been determined by the present inventors that one of the causes of the irregularity of the surface 6 is that the knives as they are cutting cause the wood to vibrate and bounce in the direction perpendicular to the axis of rotation of the knives. This results in uneveness or lack of planarity in the surface 6. The interplay of this effect and the already non-planar, i.e., trochoidal, path of the rotating knife over the surface of the translating wood can also affect the feed rate, making it less uniform. This results in further deterioration of the surface.

Figure 2:
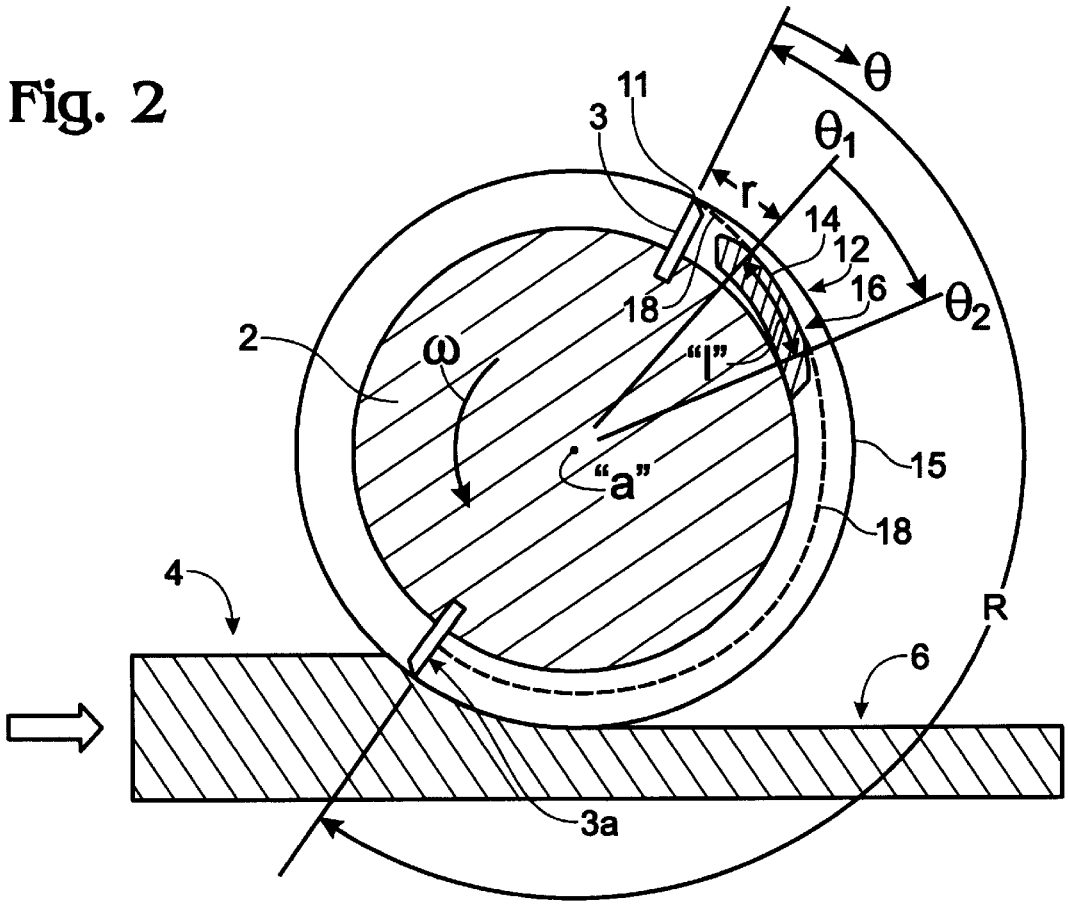
FIG. 2 is a section of the cutting head of FIG. 1 with a projection according to the present invention.

Referring to FIG. 2, to minimize or eliminate these effects a preferred wood surfacing head and method 10 according to the present invention employs a projection 12 associated with the knife 3 on the head 2. The projection is disposed on the cutting head and may be integral therewith or adapted for removal, and is positioned downstream of the knife, i.e., behind the knife with respect to the direction "ω" of rotation of the head as shown in FIG. 2. The projection 12 is adapted to contact the wood surface 6 after it is cut in such a manner that the projection controls movement of the wood 4, here vertical movement of the wood with respect to the support surface 5, without interfering with feeding of the wood.

Referring back to FIG. 1, it has been found that a projection employing a circular arc that is nearly coincident with a circle 15 defined by the tip 11 of the rotating knife 3 will apply a progressively increasing force against the wood as the wood is fed forwardly to the head, ultimately kicking the wood backwardly of its feed direction. Apparently to avoid this undesirable result, the prior art arranges to avoid making contact with the wood by any part of the cutting apparatus except the knife. The prior art accomplishes this by recessing any projecting surfaces with respect to the circle 15 so that the surfaces everywhere remain radially inside this circle sufficiently that no contact with the wood is possible during normal operation of the apparatus. Such projecting surfaces, though out of the way so as not to cause harm, cannot be of use to control undesired movements of the wood.

Turning back to FIG. 2, the projection 12 will now be described with more particularity. An outer surface 16 of the projection is shown as a curved line in FIG. 2, it being understood that the surface typically extends into and out of the plane of the Figure. According to the invention, a matching portion 14 of the surface 16 of the projection 12 matches, i.e., is substantially coincident with, a corresponding portion of a curve 18. The matching portion 14 may follow any selected portion or portions of the curve 18, as will be discussed more fully below.

The curve 18 associated with the knife 3 extends over an angular range "R." Where there is only one knife, the angular range is 360 degrees, returning to the knife 3, and where there is more than one knife, the angular range of the curve 18 corresponding to the knife 3 extends from the knife 3 to the next, adjacent knife 3*a* downstream.

For illustrative purposes, a particular location on the curve 18 is designated by an angle Θ about the axis "a" and is measured in the direction indicated in FIG. 2, with respect to a direction of rotation "ω" of the head 2. In general, the curve 18 intersects the circle 15 at the tip 11 of the knife and falls inwardly away from the circle 15 with increasing angle Θ or equivalently, with increasing distance from the tip of the knife, at a predetermined geometric rate (hereinafter "rate") until reaching the next knife.

The rate at which the curve 18 falls from the circle 15 is predetermined to permit the desired rate of advancement of the wood during the time required for a next knife to become positioned to make a next cut in the wood. The rate generally corresponds to the feed velocity [and, so long as this is greater than zero, may be any decreasing function of distance from the tip of the knife]. Where the feed velocity is a function of time that varies within the period of rotation of the cutting head, the feed velocity is synchronized with the rotation of the head to reduce the time dependence of the feed velocity to a geometrical dependence on the angle Θ.

Figure 3:
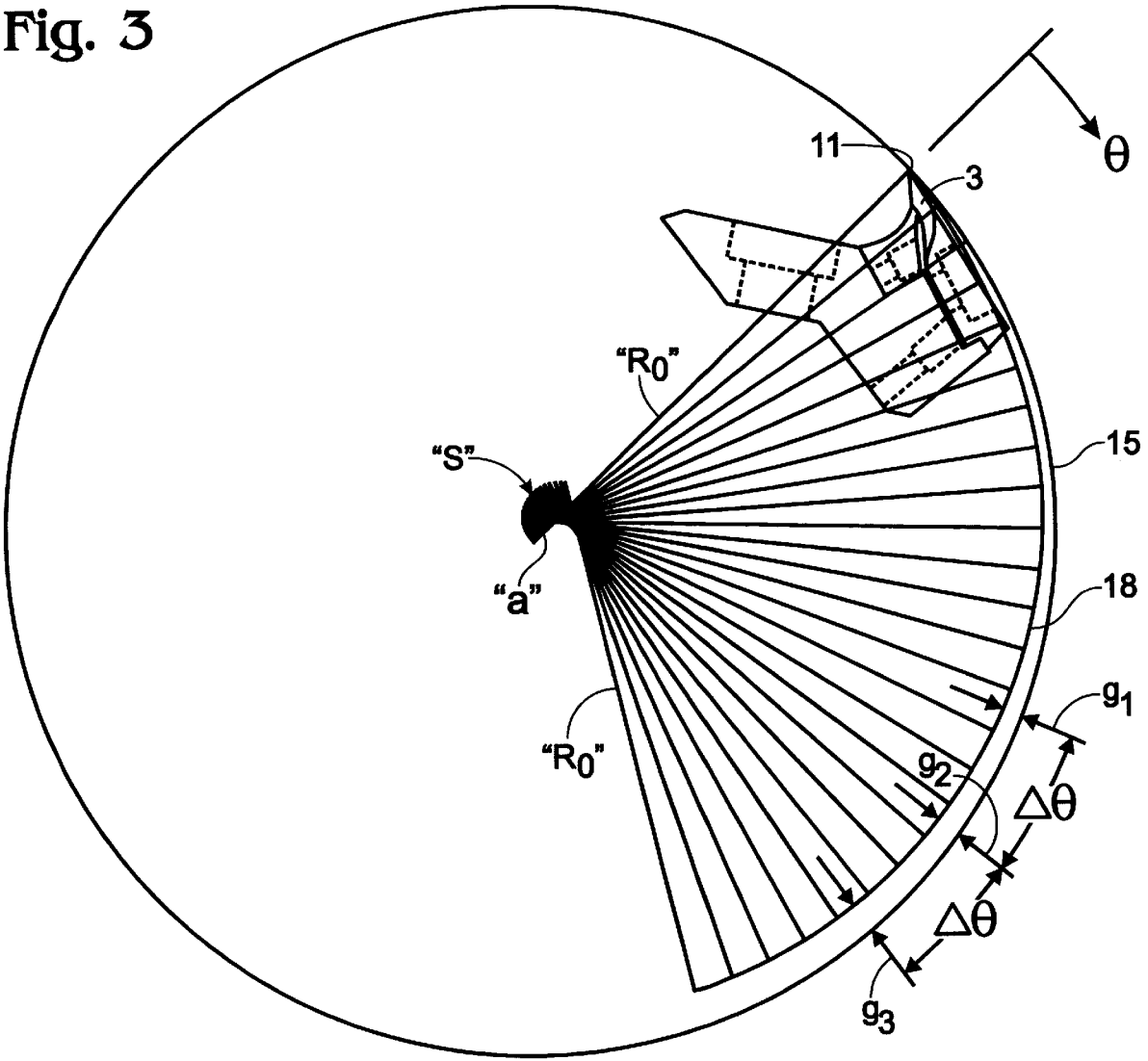
FIG. 3 is a diagram of a curve for use in matching the configuration of the projection of FIG. 2.

For typical mill conditions wherein the wood feed rate is substantially constant, the curve 18 takes the particular shape exemplified in FIG. 3. The curve 18 shown in FIG. 3 has a constant radius of curvature "$R_0$" whose center follows a spiral shaped path "s" that spirals outwardly of the center of the circle 15. The result is that the curve 18 falls inwardly away from the circle 15 at a constant [(geometric)]rate, i.e., for [a 3] three increasing values of Θ spaced ΔΘ apart as shown, the distances $g_1$, $g_2$, and $g_3$, between the circle 15 and the curve 18 for the three values of Θ are related as $(g_2-g_1)=(g_3-g_2)$. It should be noted that the distances "g" need not represent large deviations from the circle 15 to provide the desired relief.

The matching portion 14 of the projection surface 16 may occupy any desired portion or portions of the angular range, such as between $\Theta_1$ and $\Theta_2$ shown in FIG. 2, including the entire available range. Moreover, the corresponding arc length "l" of the matching portion 14 may be quite small and still yield an advantage, e.g., good results may be obtained with 1=½" or less. On the other hand, the arc length of the matching portion should not approach zero, e.g., become knife-like, or it may damage the wood surface. Preferably, the matching portion 14 commences at $\Theta_1$ within a distance "r" of about 3" behind the tip 11 of the knife.

The manner of modifying the geometry of the projection 12 for non-uniform feed velocity will be apparent to those of ordinary mechanical skill as a result of applying the foregoing general principle in light of the example given.

The projection 12 as aforedescribed is spaced with respect to the circle 15 so that it contacts the wood over one or more selected portions of the curve 18 with substantially a constant amount of controlling force, e.g., the force of contact between the head and the wood for controlling undesired movements of the wood does not change substantially as the head rotates and as the wood is fed.

It is to be recognized that, while a specific wood surfacing method and apparatus has been shown and described as preferred, other configurations could be utilized, in addition to configurations already mentioned, without departing from the principles of the invention. Moreover, the principles described above apply equally well to cutting heads that do not extend axially, e.g., for cutting lines rather than surfaces.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

I claim:

1. A wood cutting head for cutting articles of wood and adapted for rotating a knife about an axis wherein the tip of the knife defines a circle in a plane perpendicular to the axis, the cutting head being further adapted to cut the articles of wood in response to translating the wood and the cutting head relatively toward one another along a line perpendicular to and in a plane that does not include the axis, the cutting head comprising a projecting surface disposed behind the knife with respect to the direction of rotation, said projecting surface having a matching portion that matches, in the plane of the circle, a corresponding portion of a curve that falls inwardly away from the circle with increasing distance from the tip of the knife at a rate that corresponds to the speed of the relative translation related to the angular position of the cutting head.

2. The apparatus of claim 1, wherein the speed of relative translation is substantially constant over at least one period of rotation of the cutting head, and wherein said curve falls inwardly away from the circle at a substantially constant rate.

3. The apparatus of claim 1, wherein said matching portion commences within about 3" behind the tip of the knife.

4. A wood cutting head for cutting articles of wood and adapted for rotating a knife about an axis, the cutting head being further adapted to cut the articles of wood in response to translating the wood and the cutting head relatively toward one another along a line perpendicular to and in a plane that does not include the axis, the cutting head comprising a projecting surface projecting from the cutting head and disposed behind the knife with respect to the direction of said rotation, the knife being positioned to cut the wood during said rotating, said projecting surface being positioned for making contact with the cut surface of the wood.

5. The apparatus of claim 4, wherein said projecting surface is adapted so that said contact produces a force that is substantially constant during said contact.

6. A wood cutting method for cutting articles of wood with a cutting head carrying one or more knives and a non-cutting portion, comprising:

rotating the cutting head so as to rotate the one or more knives and the non-cutting portion about an axis;

cutting the wood with one of the knives as a result of said rotating while relatively translating the wood with respect to the cutting head toward the axis along a line perpendicular to and in a plane that does not include the axis; and making contact with the cut surface of the wood by the non-cutting portion.

7. The method of claim 6, wherein said step of making contact includes producing a force that is substantially constant during said step of making contact.

8. The method of claim 7, wherein said step of rotating includes rotating said one knife so that the tip thereof defines a circle in a plane perpendicular to the axis, said non-cutting portion having a matching portion that matches, in the plane of the circle, a corresponding portion of a curve that falls inwardly away from the circle with increasing distance from the tip of the knife at a rate that corresponds to the speed of relative translation related to the angular position of the cutting head.

9. The method of claim 8, wherein said translating is at a substantially constant speed between the time the wood is cut by said one knife and said next knife, and wherein said curve is provided to fall inwardly away from the circle at a substantially constant rate.

* * * * *